US009248323B1

(12) United States Patent
Larsen

(10) Patent No.: US 9,248,323 B1
(45) Date of Patent: Feb. 2, 2016

(54) FALL PREVENTION APPARATUS

(75) Inventor: Jesse B. Larsen, Tumwater, WA (US)

(73) Assignee: G-CORP, Tumwater, WA (US)

( * ) Notice: Subject to any disclaimer, the term of this patent is extended or adjusted under 35 U.S.C. 154(b) by 362 days.

(21) Appl. No.: 13/573,119

(22) Filed: Aug. 24, 2012

Related U.S. Application Data

(60) Provisional application No. 61/626,673, filed on Sep. 29, 2011.

(51) Int. Cl.
*A62B 35/00* (2006.01)

(52) U.S. Cl.
CPC ..... *A62B 35/0043* (2013.01); *A62B 35/0068* (2013.01)

(58) Field of Classification Search
USPC ..... 182/3, 45
See application file for complete search history.

(56) References Cited

U.S. PATENT DOCUMENTS

| | | | | | |
|---|---|---|---|---|---|
| 1,423,998 | A | * | 7/1922 | Camp | 182/38 |
| 3,237,717 | A | * | 3/1966 | Jackson | 182/3 |
| 5,036,949 | A | * | 8/1991 | Crocker et al. | 182/3 |
| 5,320,194 | A | * | 6/1994 | Bredijk | 182/45 |
| 5,351,585 | A | | 10/1994 | Leseberg et al. | |
| 5,718,305 | A | | 2/1998 | Palmer | |
| 5,758,743 | A | * | 6/1998 | Coyle et al. | 182/45 |
| 5,878,534 | A | | 3/1999 | Gleave | |
| 6,786,020 | B2 | * | 9/2004 | Poldmaa | 52/704 |
| 8,292,030 | B2 | * | 10/2012 | Ballantyne | 182/45 |
| 8,636,108 | B2 | * | 1/2014 | Foster et al. | 182/45 |
| 2006/0156645 | A1 | * | 7/2006 | Munday et al. | 52/122.1 |
| 2007/0034449 | A1 | * | 2/2007 | Leendertse | 182/45 |
| 2007/0272485 | A1 | * | 11/2007 | Baake | 182/45 |
| 2008/0042030 | A1 | * | 2/2008 | Holling et al. | 248/237 |
| 2010/0108442 | A1 | * | 5/2010 | Ballantyne | 182/129 |
| 2012/0167728 | A1 | * | 7/2012 | Miramontes | 81/324 |
| 2012/0241251 | A1 | * | 9/2012 | Painter | 182/45 |
| 2012/0312633 | A1 | * | 12/2012 | Massey | 182/3 |

OTHER PUBLICATIONS

Flynt Ballentine, Eve Hook, Fall Protection, on Internet at www.youtube.com/watch?v=OiNqzEXR7w8 [copy attached], dated May 12, 2009, demonstrating the invention disclosed, illustrated and claimed in U.S. Pat. No. 8,292,030 B2.

* cited by examiner

*Primary Examiner* — Charles A Fox
*Assistant Examiner* — Kristine Florio
(74) *Attorney, Agent, or Firm* — Brian J. Coyne

(57) ABSTRACT

A portable fall prevention apparatus. The apparatus provides points of attachment for a tether line to which a safety harness worn by a workman on a sloped roof can be attached. A pair of grapples attach to opposite, overhang portions of a sloped roof. A tie down strap threaded through a ratchet tie down connects each of the grapples to oppositely-disposed, oppositely-directed hinge plates of an anchor assembly. With the anchor assembly placed transversely across the ridge of a sloped roof and the tie down straps tightened to eliminate slack therein, the anchor assembly provides a secure point of attachment for a tether line.

20 Claims, 16 Drawing Sheets

FALL PREVENTION APPARATUS

CROSS-REFERENCE TO RELATED PATENT APPLICATIONS

This application claims the benefit of provisional application No. 61/626,673 by the same applicant for the same invention, filed on Sep. 29, 2011.

STATEMENT REGARDING FEDERALLY APPROVED RESEARCH OR

DEVELOPMENT: None.

BACKGROUND OF THE INVENTION

1. Field of the Invention

This invention relates generally to devices for preventing falls from heights, and, more particularly, to such devices for attachment to a safety harness worn by a person working on the roof of a building.

2. Background Art

To avoid bodily injury from an accidental fall, workmen, while installing, removing, cleaning or repairing roofing on a building, commonly wear a safety harness that is releasably attached to a tether line and a snap hook or shackle to a secure point on the building or attached to a catenary or traveling restraint line extending between two secure points on the building. Incorporated into some buildings are building components intended and designed to provide such secure attachment points; see, for example, the roof ridge safety device disclosed in U.S. Pat. No. 5,878,534 and the safety harness attachment post assembly disclosed in U.S. Pat. No. 5,718,305. Such secure points on a building, however, are not always conveniently available, or available at all, to a workman for this purpose. In particular, prior to the present invention, no apparatus has been disclosed that provides a point of attachment for a tether line at the ridge of a sloped roof and which can be easily and rapidly attached to, and disattached from, the roof.

SUMMARY OF THE INVENTION

Thus, there remains a need for a portable apparatus that can provide a point of attachment for a first end of a tether line at the ridge of a sloped roof such that a second, opposite end of the tether line can be attached to a safety harness worn by a worker. The present invention meets this need by providing a portable apparatus that quickly and easily attaches to a sloped roof of a building to provide a secure point of attachment at the roof ridge for a tether line. In a preferred embodiment, the apparatus includes an anchor assembly for transverse placement across the ridge of a sloped roof, a pair of grapples that are mountable over oppositely-disposed, peripheral, overhang portions of the sloped roof, a pair of ratchet tie downs, and a pair of ratchet tie down straps, each of said straps being threaded through one of the ratchet tie downs. The anchor assembly includes a hinge comprising first and second hinge plates. The hinge plates have a plurality of aligned, interleaved knuckles through which is inserted a hinge pin. Underlying and attached to each hinge leaf is a block—for example, a wooden block—which blocks are disposed parallel to the hinge pin, and are transversely spaced-apart from each other. The anchor assembly further includes a plurality of upstanding eye bolts that provide attachment points for a tether line, which eye bolts are inserted through apertures in the hinge plates at points thereon intermediate the blocks and secured to the hinge plates by threaded nuts. Preferably, there are six eyebolts—one pair of eyebolts attached to the first plate adjacent to the hinge pin, a second pair of eyebolts attached to the second hinge plate adjacent to the hinge pin; an eyebolt attached to a free, distal end of the first hinge plate, and an eyebolt attached to a free, distal end of the second hinge plate.

Each grapple includes a parallel pair of spaced-apart, straight, bars. Preferably, a rubber cup is placed over each of the opposite, free ends of each of the parallel bars to enhance frictional engagement of the parallel bars with a building's roof and eaves. Mid portions of the parallel bars are joined by an arcuate, bight portion that is shaped and dimensioned to receive and surround a peripheral, overhang portion of a pitched or sloped roof such that one of the parallel bars will rest upon the sloped surface of the roof and the other parallel bar will engage the flat undersurface of the eave immediately below said sloped roof surface. A conventional, spring-loaded clasp is attached to a first end of a tether line for connecting the tether line to one of the eyebolts, and a snap hook is attached to a second, opposite end of the tether line for connecting it to a safety harness worn by a workman.

Accordingly, it is a principal object of the invention to provide a portable safety harness attachment apparatus for tethering a workman to the ridge of a pitched roof of a building, said pitched roof including a pair of roof overhangs on opposite sides of said ridge.

It is a further object of the invention to provide such an apparatus having an anchor assembly that can be securely attached to, and straddle, the ridge of a pitched roof, and provide a point of attachment for a proximal end of a tether line, an opposite, distal end of said tether line being attachable to a safety harness worn by a workman on the roof.

It is still another object to provide such an apparatus wherein said anchor assembly includes a hinge comprising first and second hinge plates and a hinge pin inserted through aligned, interleaved knuckles of said hinge plates; first and second grapples attachable to said pair of roof overhangs; and a pair of ratchet tie down straps threaded through a pair of ratchet tie downs for attaching said hinge plates to said grapples, whereby reciprocal movement of the handles on the ratchet tie downs tightens said straps and thereby secures said apparatus firmly in place on the ridge of the roof.

These and other objects of the invention will be apparent from the drawings, the detailed description, and the claims set forth below.

BRIEF DESCRIPTION OF THE DRAWINGS

Like numerals denote like parts throughout the several views.

DETAILED DESCRIPTION

Figure 1:
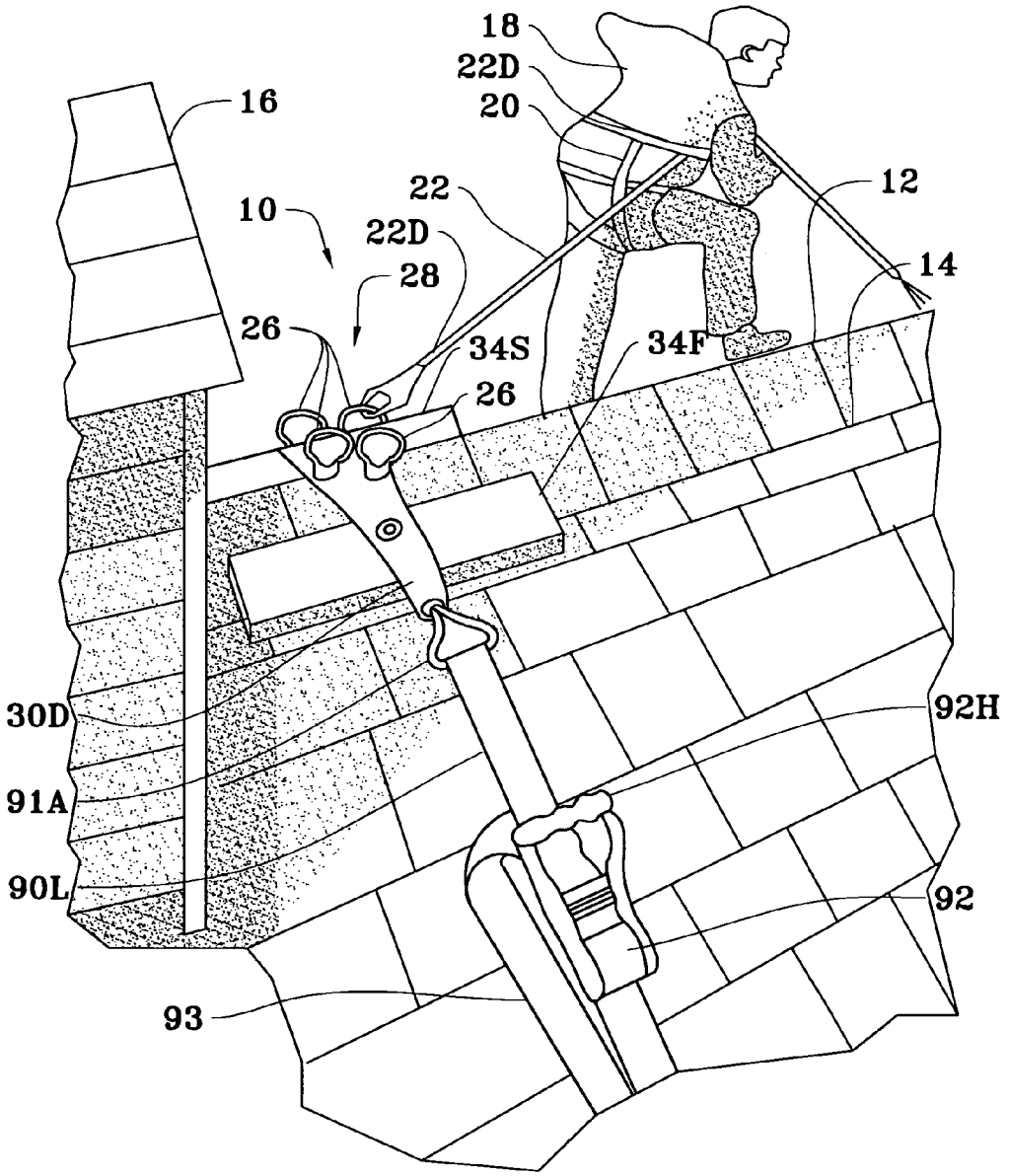
FIG. 1 is a fragmentary, perspective view of a building having a shingled, sloped roof, depicting a preferred embodiment of the apparatus of the present invention disposed transversely across the ridge of the roof and a workman tethered to the apparatus while pressure washing the roof.
Figure 2:
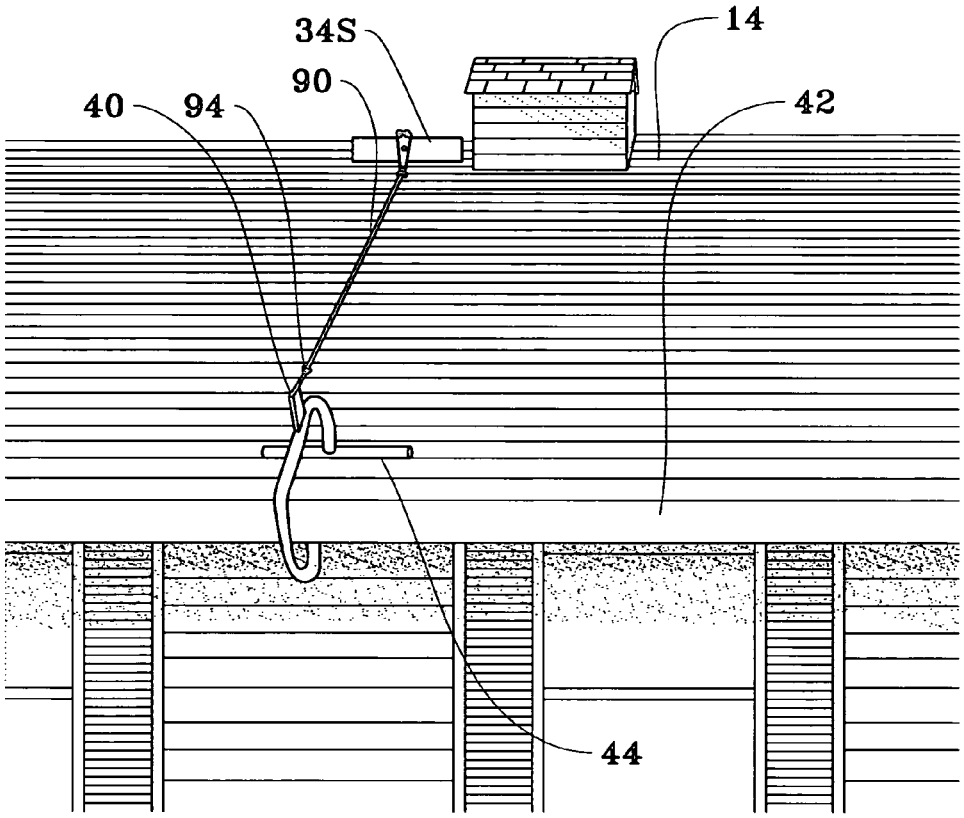
FIG. 2 is a perspective view thereof, depicting an opposite side of the same building.

Referring to FIG. 1, the apparatus, denoted generally by the numeral 10, of a preferred embodiment of the present invention is shown in use, straddling the ridge 12 of a sloped roof 14 of a building 16 upon which a workman 18 is standing while he pressure washes the roof. The workman 18 is wearing a safety harness 20 that is attached by a snap hook 21 to a distal end portion 22D of a tether line 22. An opposite, proximal end 22P of the tether line 22 is attached by a conventional, spring-loaded clasp 24 to an upstanding eyebolt 26 of an anchor assembly, denoted generally by the number 28.

Referring to FIGS. 1, 5, 10 and 17, it may be seen that the anchor assembly 28 includes a conventional butt hinge 30 having a first hinge plate 30F and a second hinge plate 30S pivotally joined to one another by a hinge pin 32 that is inserted through the adjacent, proximal, pintle edge portions 32P of said hinge plates. When the anchor assembly 28 is properly positioned on the ridge 12 of a sloped roof 14 and ready for use, the hinge pin 32 overlies and is parallel to the ridge. Underlying and attached to each hinge plate 30F, 30S by a fastener 31 (e.g., a bolt and washer) is a block 34F, 34S, respectively. Each block 34F, 34S has a generally rectilinear shape, including a flat bottom surface for secure engagement with a roof surface. Preferably, a rectilinear, friction pad 36F, 36S is attached to the bottom surface of each block 34F, 36S, respectively, to enhance frictional engagement with a roof surface. The blocks 34F, 34S are disposed on opposite sides of the hinge pin 32 and on opposite sides of the ridge 12, are spaced apart from the hinge pin, and are oriented parallel to the hinge pin and to the ridge. A pair of upstanding eyebolts 26 are inserted through apertures in each of the hinge plates 30F, 30S, and secured thereto by nuts 33, intermediate the hinge pin 32 and the respective attached blocks 34F, 34S. The distal end portions 30D of each of the hinge plates 30F, 30S are downturned and apertured. An upstanding eyebolt 26 is inserted into the apertures of the downturned, distal portions 30D of each of the hinge plates 30F, 30S and secured thereto by nuts 33.

Figure 9:
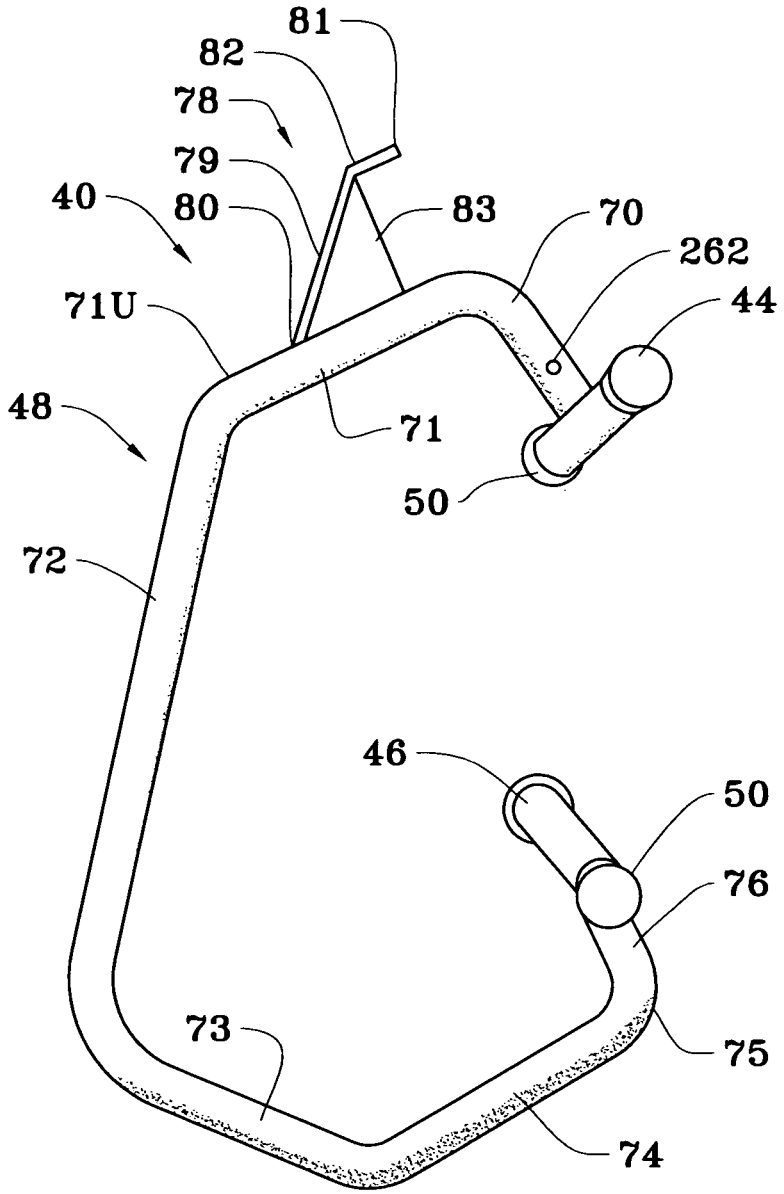
FIG. 9 is a side, perspective thereof.
Figure 10:
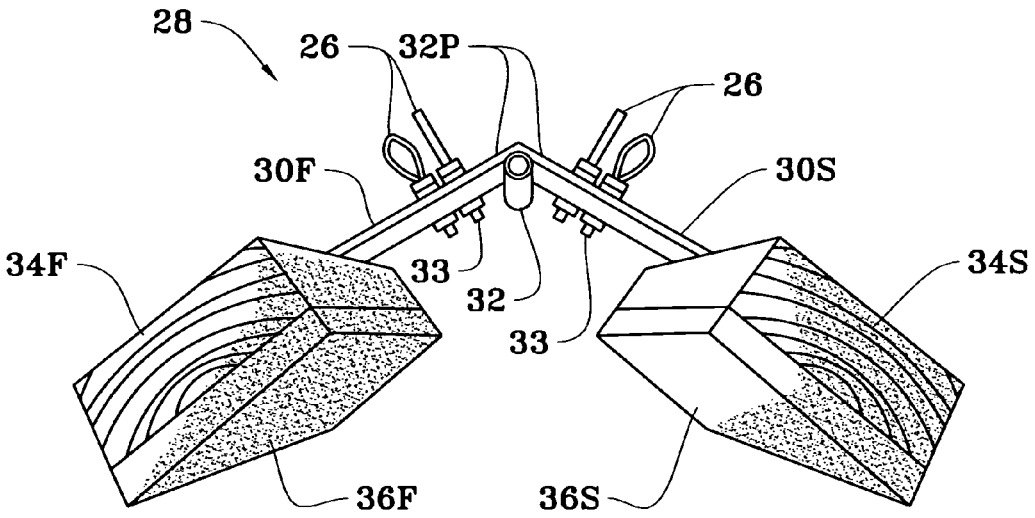
FIG. 10 is an enlarged front, perspective view of an anchor assembly.

Referring to FIGS. 2, 3, 4, 8, and 9, the apparatus includes a pair of grapples 40 for securing the apparatus to oppositely-disposed, peripheral, overhang portions 42 of a sloped roof 14. To that end, each grapple 40 includes an upper bar 44, a vertically-spaced apart, lower bar 46 that is parallel to the upper bar and an arcuate, bight portion 48 that lies in a plane perpendicular to the upper and lower bars and joins mid portions of the upper and lower bars to each other. Preferably, rubber cups 50 are placed over the opposite, free ends of each of the bars 44, 46, as depicted in the drawings. In the illustrated, preferred embodiment, the bight portion 48 comprises a series of six legs 70, 71, 72, 73, 74, 75, 76, connected one to the other in tandem wherein leg 70 is attached to a mid portion of the upper bar 44 and leg 76 is attached to a mid portion of the lower bar 46. When viewed in left side elevation as depicted in FIG. 9, said legs 70-76, inclusive, approximate the shape of an uppercase letter "G." It will be understood, however, that the bight portion 48 need not comprise individual legs connected in tandem and could be formed in a similar shape from a single length of a suitably strong and light weight material, for instance, plastic or aluminum tubing. A lug 78 extends upwardly and forwardly from an upper surface 71*u* of leg 71. The lug 78 includes a plate 79 that extends from a first end thereof 80 to a second, opposite, free end 81 thereof, which plate is bent at an obtuse angle at a location 82 thereon intermediate said first and second ends 80, 81. The first end 80 engages the upper surface 71*u* of leg 71 and the plate is supported by a triangular gusset plate 83 that extends from said upper surface 71*u* to that portion of the plate 79 that extends from the first end 80 to the bend location 82 thereof. The remaining, free end portion of the lug 78 is apertured for convenient attachment of a ratchet tie down strap 90 whenever the grapple 40 is to be placed into use on the overhang portion 42 of a sloped roof 14.

Figure 3:
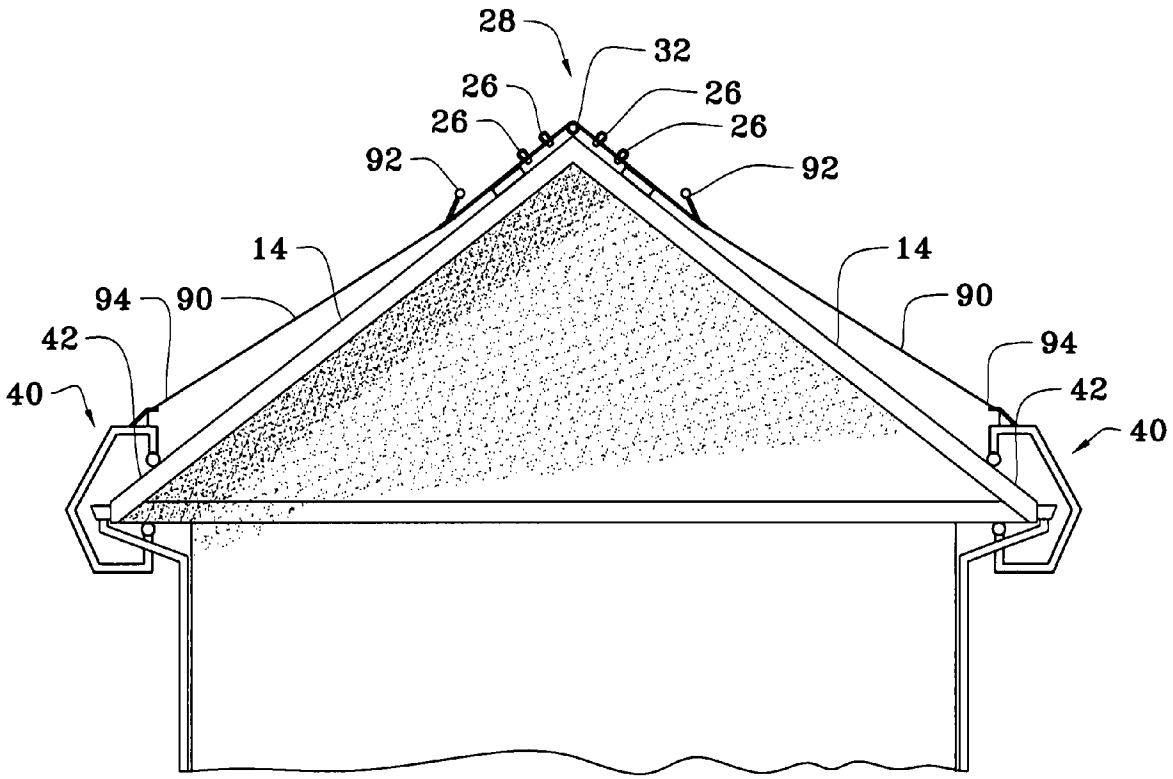
FIG. 3 is a schematic, elevational view of an upper, gable-end portion of a building upon the roof of which a preferred embodiment of the present invention has been installed, and ready for attachment of a tether line thereto.
Figure 4:
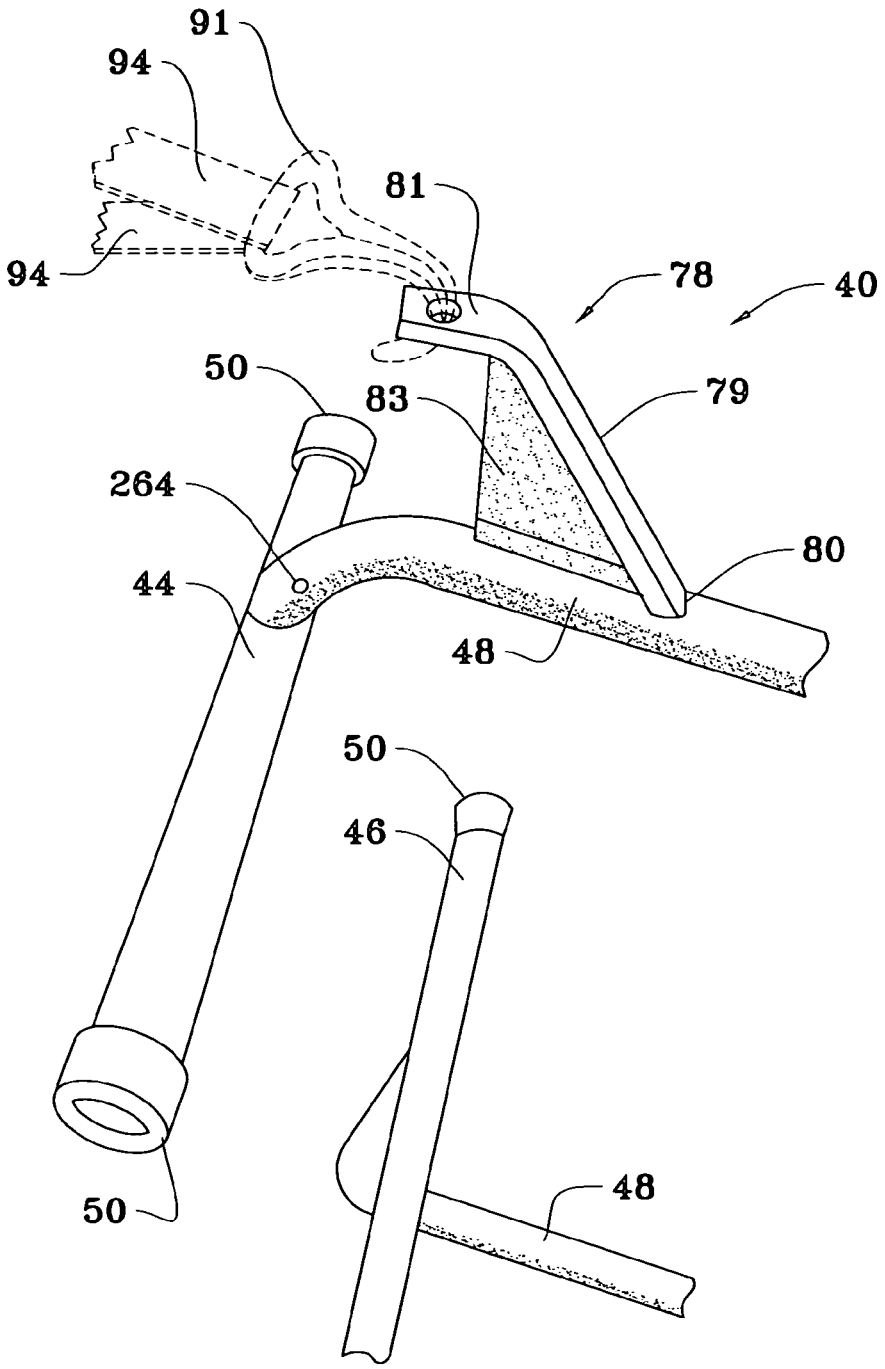
FIG. 4 is partial, perspective, top view of a grapple of the present invention depicting a second toe hook joining a free end of a ratchet tie down strap to a grapple.
Figure 5:
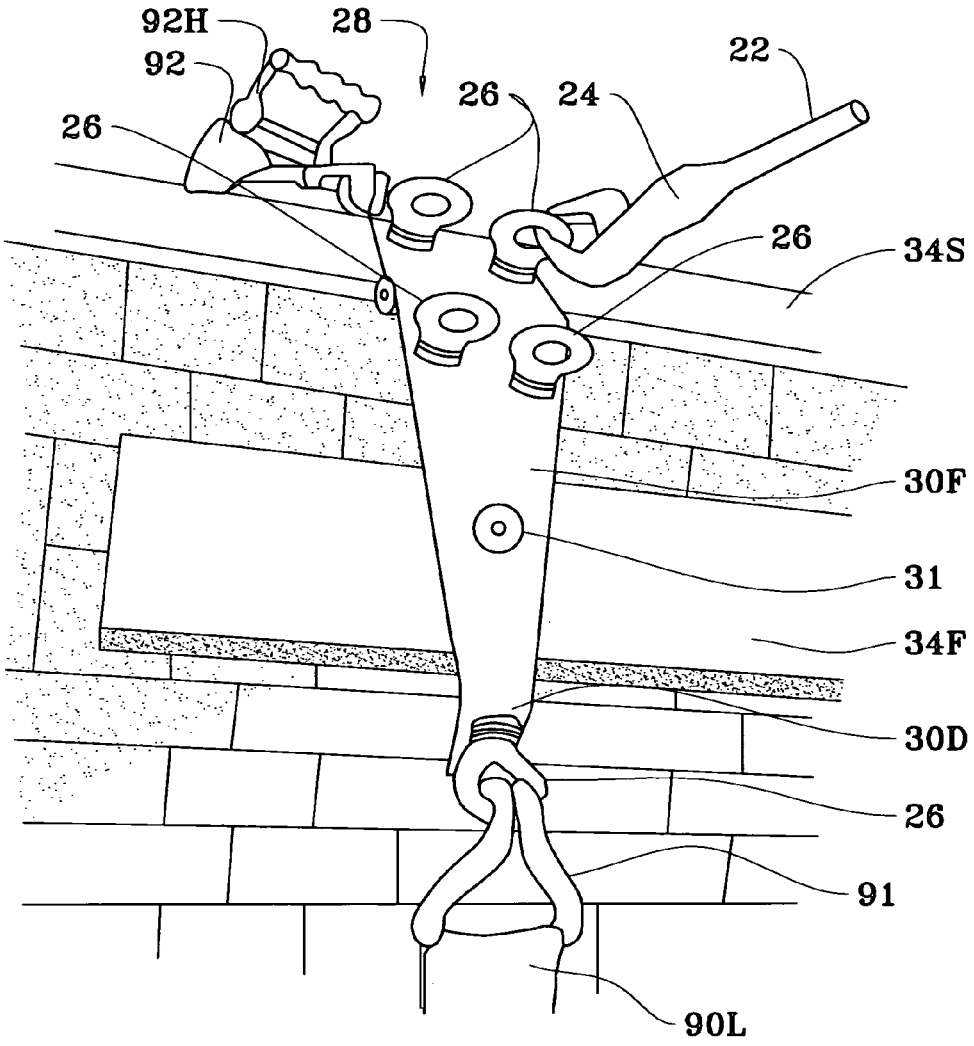
FIG. 5 is an enlarged, fragmentary, perspective view of the apparatus depicted in FIG. 1 showing a first toe hook attached to a hinge plate.
Figure 6:
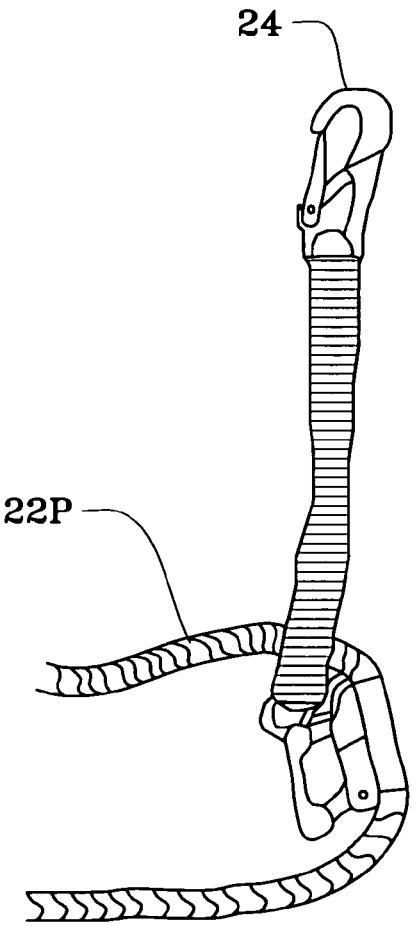
FIG. 6 is a perspective view of a proximal end portion of a tether line and of a spring-loaded clasp attached thereto.
Figure 7:
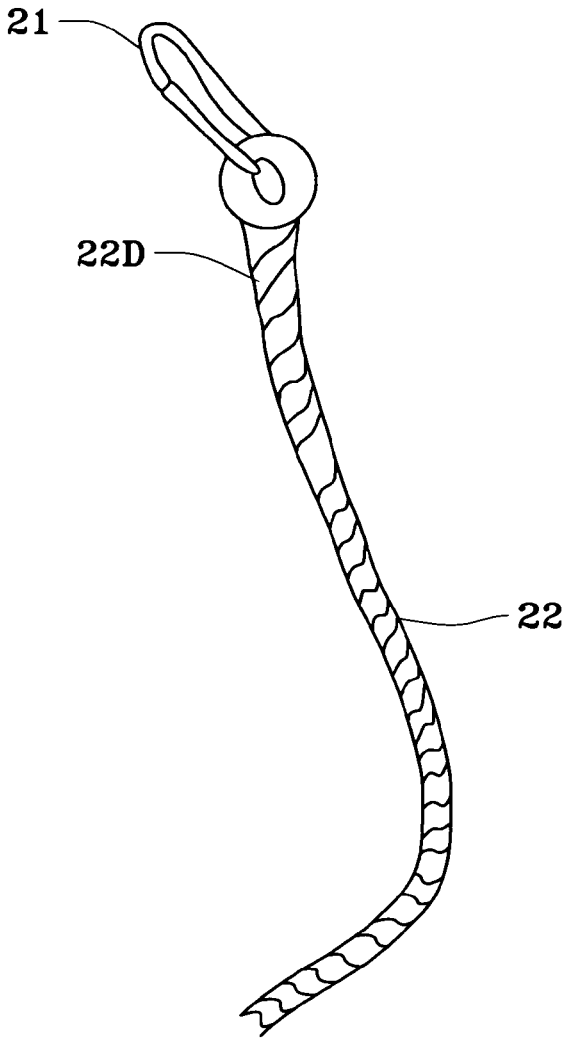
FIG. 7 is a perspective view of a distal end thereof and of a snap hook attached thereto.
Figure 8:
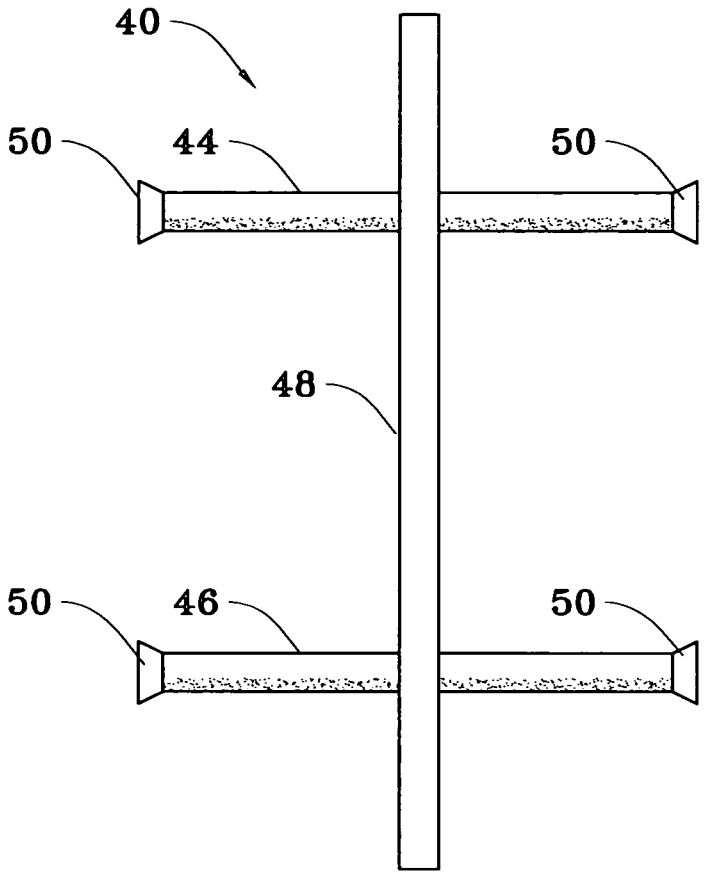
FIG. 8 is an enlarged, rear, elevational view of a grapple of a preferred embodiment of the present invention.

Referring now to FIGS. 1 and 3, it is seen that the apparatus 10 further includes a pair of conventional ratchet tie downs 92 and a pair of tie down straps 90. Each tie down strap 90 has a proximal end portion 93 that is threaded through one of the ratchet tie downs 92, a proximal loop portion 90L that extends in a first direction and through which a first toe hook 91A is inserted, and an opposite, distal, free end 94 that extends away from the ratchet tie down in a second, opposite direction. When the apparatus 10 is being readied for use on a sloped roof 14, a first toe hook 91A is inserted into an eyebolt 26 at each of the distal, downturned ends 30D of the nearest hinge leaves 34F, 34S, whereby the proximal loops 90L of the ratchet tie downs 92 are connected to the hinge leaves and extend away from the anchor assembly 28 in opposite directions. A second toe hook 91B is attached to each proximal loop of the free end of a tie down strap, and insertion of those toe hooks 91B into the apertures of the lugs 78 thereby connects the ratchet tie downs 92 to the grapples 40.

Accordingly, the portable apparatus 10 provides its own points of attachment for a tether line 22 to which a safety harness 20 worn by a workman 18 on a sloped roof 14 can be conveniently attached and disattached. In use, the anchor assembly 28 is placed transversely across the ridge of a sloped roof 14, and the blocks 34F, 34S thereof are pressed down until they engage the opposite, sloped surfaces of the roof. A ratchet tie down 92 is placed upon each of the two sloped roof surfaces a few feet, more or less, below the ridge. A first toe hook 91A attached to a proximal loop 90L that extends from each ratchet tie down 92 is then inserted into an aperture of the nearest, downturned end 30D of a hinge plate 34F or 34S to connect the ratchet tie downs to the anchor assembly 28. The free ends 94 of the tie down straps 90 that are threaded through the ratchet tie downs 92 are placed near oppositely-disposed, peripheral, overhang portions 42 of the sloped roof. A grapple is placed over each of the oppositely-disposed, peripheral, overhang portions 42 of the sloped roof such that an upper bar 44 of the grapple rests upon the sloped roof and a lower bar 46 engages a lower surface of the roof eave immediately below. Second toe hooks 91B attached to the free ends 94 of the straps 90 are then inserted into the apertures of the lugs 78 to connect each of the grapples 40 to the nearest ratchet tie down. Each ratchet handle 92H is then moved back and forth to take up any slack in the portion of the tie down straps that extends between the ratchet tie down 92 and the attached grapple 40. A proximal end 22P of the tether line 22 is then attached to a convenient one of the eyebolts 26 of the anchor assembly 28 and an opposite, distal end 22D thereof is attached to a safety harness 20 worn by a workman 18 in the manner described above. To remove the apparatus 10 from a sloped roof 14, those steps are carried out in reverse order.

Figure 11:
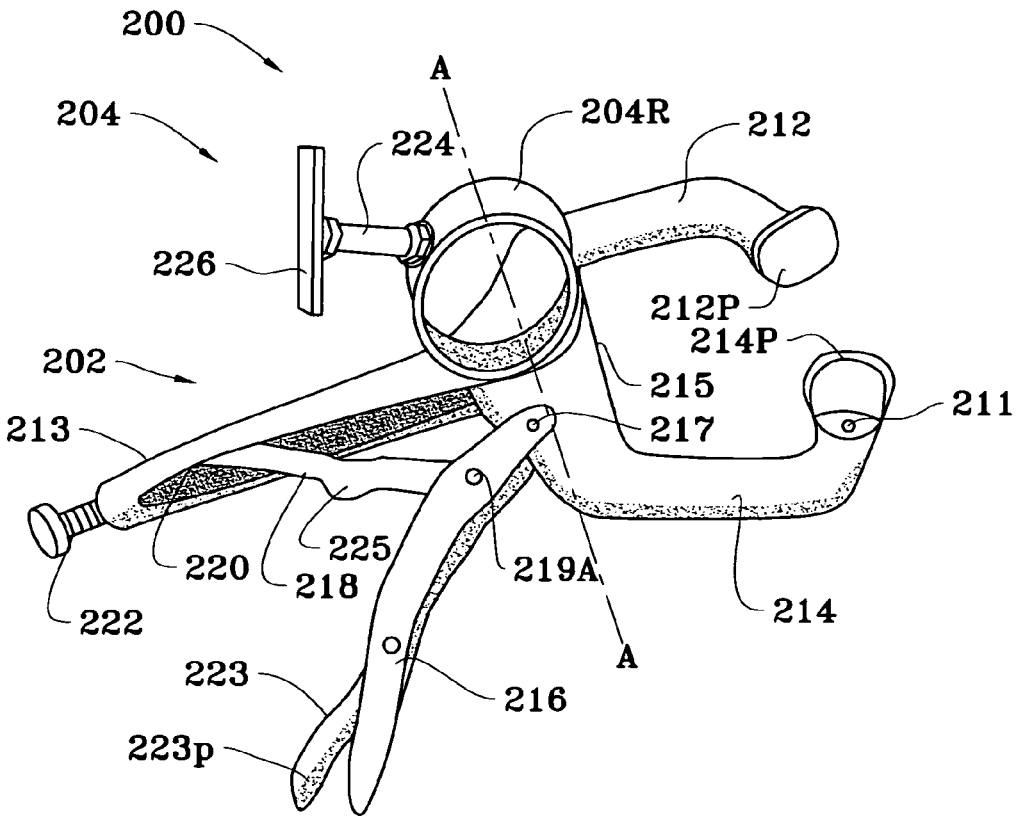
FIG. 11 is top, perspective view of a combination clamp ring and locking C-clamp with swivel pads.

In order to simplify the task of mounting a grapple to an accessible rafter 210 of an overhang portion 42 of a roof 14, the invention preferably further includes a combination clamp ring and locking C-clamp, denoted generally by the numeral 200; FIG. 11. The combination 200 includes a locking C-clamp to which is attached the cylindrical, ring portion 204R of a first clamp ring 204, by welding, for example. The locking C-clamp is of conventional construction and has a fixed jaw 212 integrally joined to a stationary handle 213 and a movable jaw 214 pivotally attached to the fixed jaw at a first pivot point 215 where the fixed jaw joins the stationary handle. Distal end portions of each of the fixed jaw 212 and the movable jaw 214 are contoured inwardly toward each other, and each terminates in a swivel pad 212P, 214P, respectively, attached thereto by pivot pins 211. A locking handle 216 is pivotally attached to the movable jaw 214 at a second pivot point 217 located on a proximal portion of the movable jaw. The C-clamp further includes a toggle linkage 218 having a first end pivotally attached to the locking handle 216 at a third pivot point 219 and an opposite, second end that is slidably moveable within a channel 220 of the stationary handle 213; that is, moving the handles 213, 216 toward each other slides the first end of the toggle linkage proximally within the channel, whereas moving the handles away from each other moves it distally within the channel. A screw adjuster 222 threadably mounted within a proximal portion of the channel 220 of the stationary handle 213 permits adjustment of the extent of travel proximally of the second end of the toggle linkage 218; thus, to widen the expanse of the jaws 212, 214 the screw adjuster must be withdrawn proximally, and, to narrow the expanse of the jaws, the screw adjuster must be advanced distally. A release lever 223 is pivotally attached by a fourth pivot point 227 to a proximal portion of the locking handle 216. The release lever 223 is disposed such that, when the handles are squeezed together to cause the jaws to bear against opposite sides of a roof rafter 210, a knee extension 225 of the toggle linkage 218 engages a distal end (not shown) of the release lever, locking the C-clamp 200 in place. To thereafter unclamp the grapple 40 from the roof rafter 210, a proximal end 223P of the release lever is manually depressed, which disengages the knee extension 225 from the distal end of the release lever, thereby unlocking the C-clamp 200 and disengaging the jaws 212, 214 from the roof rafter.

Figure 12:
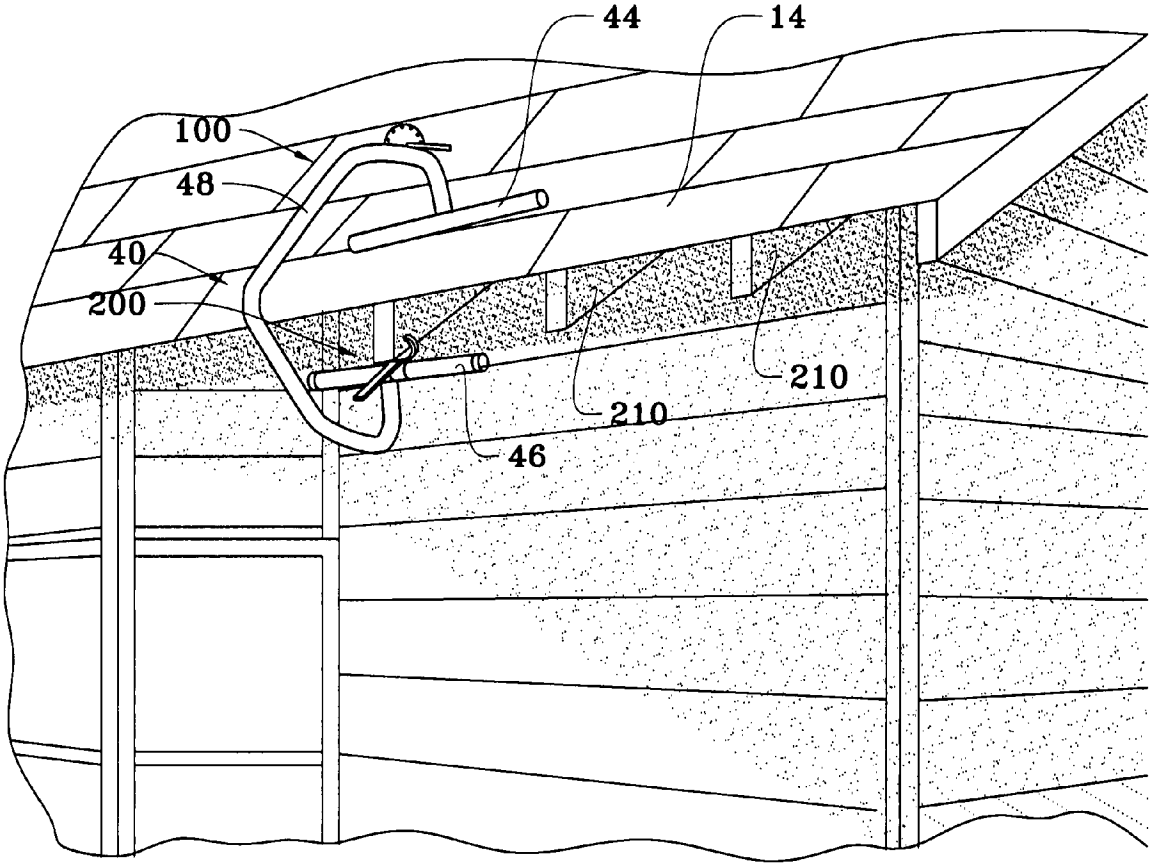
FIG. 12 depicts said combination mounted on a lower bar of a grapple and clamped to a roof rafter.

The first clamp ring 204 includes a hollow, cylindrical ring portion 204R having a cylindrical axis A-A perpendicular to the stationary handle and internal diameter slightly greater than the external diameter of the lower bar 46 of a grapple 40 so as to be mountable thereon. An externally threaded spindle 224 is threadably mounted within an internally-threaded, radially-directed aperture of the ring portion 204R and a T-handle 226 is attached to a proximal end thereof. Accordingly, once the ring portion 204R has been slid onto a lower bar 46 of a grapple 40, the combination 200 can be fixed thereto by rotational advance of the spindle. Then, with the upper bar 44 of the grapple 40 resting on the surface of the roof 14 and the lower bar 46 of the grapple positioned adjacent to an exposed roof rafter 210 of an overhang portion of the roof, the locking C-clamp is adjusted and the jaws 212, 214 thereof are engaged with opposite side surfaces of the rafter; FIG. 12. A release lever 223 is pivotally attached by a fourth pivot pin 227 to a proximal portion of the locking handle 216. The release lever 223 is disposed such that, when the handles are squeezed together to cause the jaws to bear against opposite sides of a roof rafter 210, a knee extension 225 of the toggle linkage 218 engages a distal end (not shown) of the release lever, locking the C-clamp 200 in place. The combination clamp ring and locking C-clamp 200 will hold the grapple 40 in position on the roof 14 long enough for the grapple to be connected by a tie down strap 90 to the anchor assembly 28. To unclamp the grapple 40 from the roof rafter 210, a proximal end 223P of the release lever 223 is manually depressed, which disengages the knee extension 225 from the distal end of the release lever, thereby unlocking the C-clamp 200 and disengaging the jaws 212, 214 from the roof rafter.

Figure 13:
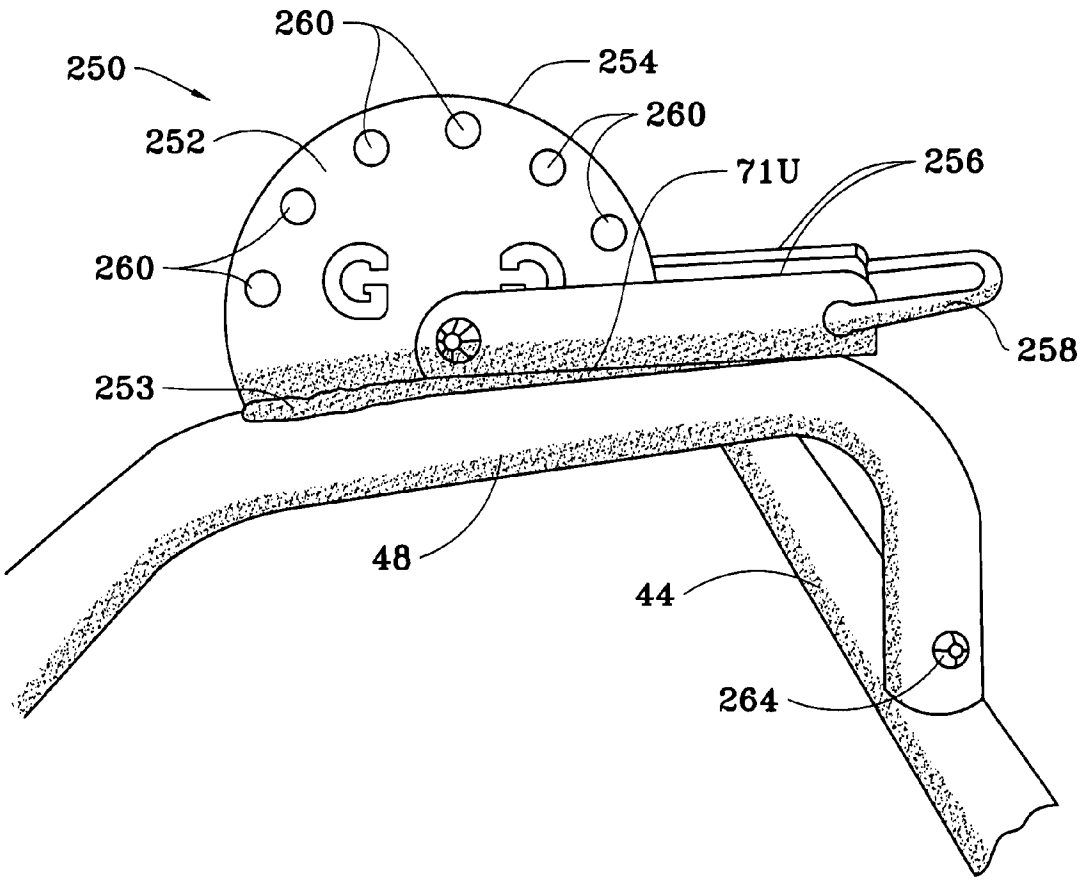
FIG. 13 is a fragmentary, enlarged view of an alternative embodiment of a grapple of the invention.
Figure 14:
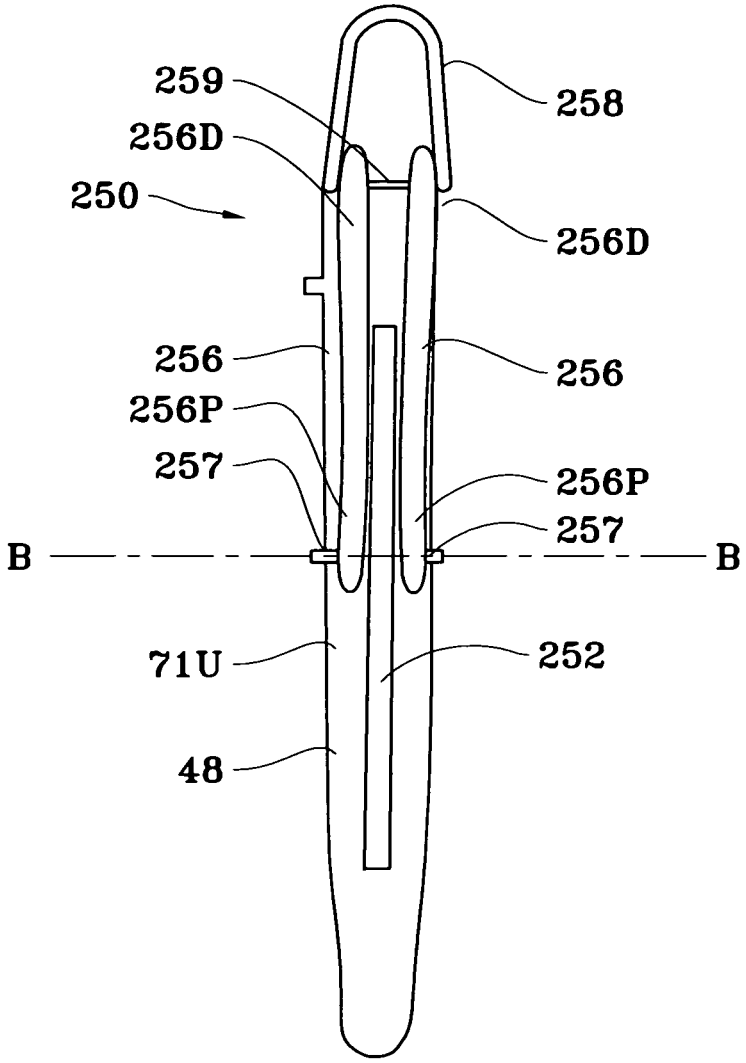
FIG. 14 is a top plan view thereof.
Figure 15:
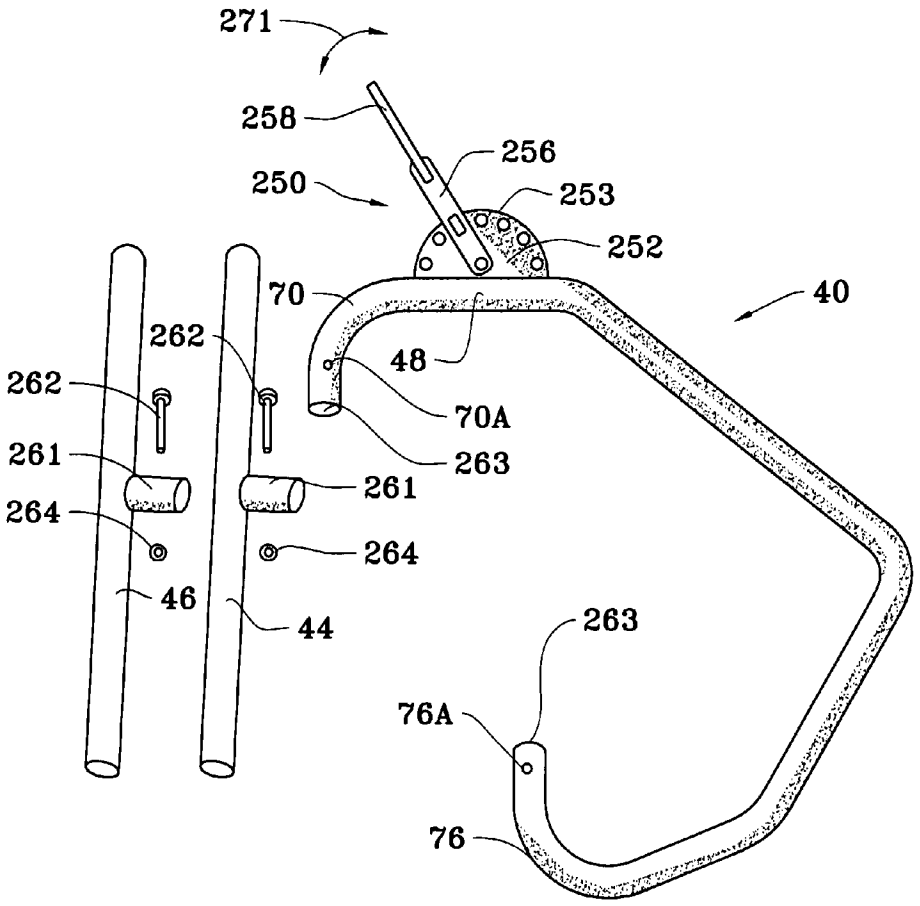
FIG. 15 depicts said grapple disassembled.

In an alternative embodiment of the invention, for attaching a tie down strap 90 to a grapple 40, a shackle assembly 250 is substituted for the lug 78. Referring to FIGS. 13-15, it is seen that the shackle assembly 250 includes an upstanding, mounting plate 252 attached to an upper surface 71*u* of leg 71 by a weld 253. An upper margin 254 of the mounting plate 252 is substantially semicircular such that the mounting plate has approximately the form of a semicircular disk of radius R as measured from a pivot axis B-B directed normally through a lower portion of the mounting plate adjacent to the weld 253. A parallel pair of arms 256, 256 disposed on opposite sides of the mounting plate are pivotally attached at their proximal ends 256P, 256P by first shackle pins 257 for rotation about axis B-B through a semicircular range of motion. Each of the arms 256, 256 has length greater than R and carries at a distal end 256D, 256D thereof a U-shaped member or bale 258 pivotally attached thereto by a second shackle pin 259 to which a distal end 94 of a tie down strap 90 can be attached. Preferably, the mounting plate has a plurality of apertures 260 circumferentially spaced-apart and adjacent the upper margin 254 thereof, through which apertures one or more pegs or other objects (e.g., screwdriver shank) can be inserted to limit the movement of the arms about axis B-B, if desired.

For easy portability and compact storage of the apparatus 10, each grapple 40 is easily disassembled into its component parts. Comparing FIGS. 9 and 15, it is seen that the upper bar 44 and lower bar 46 of a grapple 40 each have an apertured, neck extension 261 that inserts into a hollow, open end 263 of the grapple. Disassembly of an assembled grapple 40 is performed by removing the pair of bolts 262 and nuts 264 from apertures 70A, 76A in grapple legs 70, 76, and from apertures 263 in the neck extensions 261, which permits separation therefrom of the upper bar 44 and of the lower bar 76, respectively.

Figure 16:
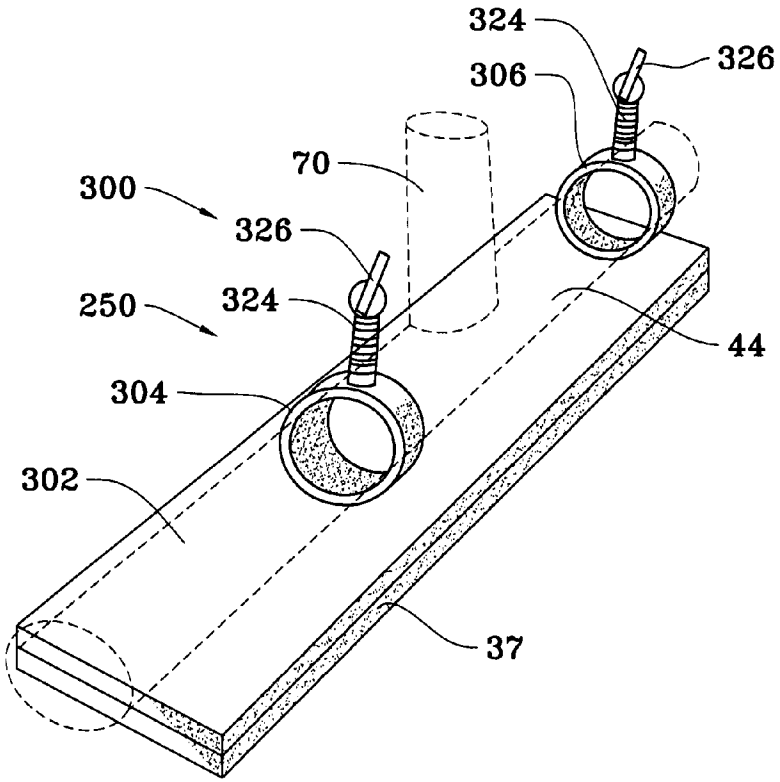
FIG. 16 is a top, perspective view of a friction pad clamp assembly shown attached to an upper bar (phantom lines) of a grapple.
Figure 17:
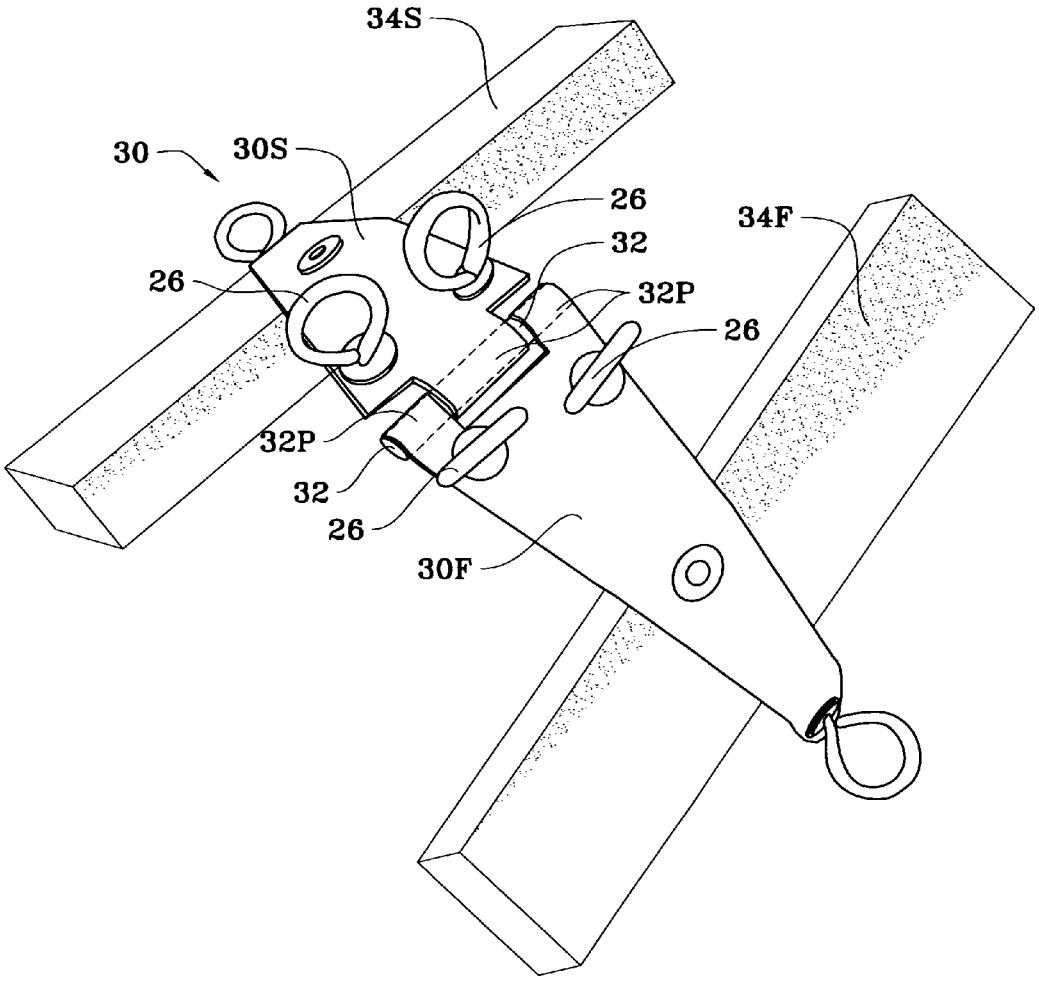
FIG. 17 is a perspective view of the hinge portion of the anchor assembly, showing the aligned, interleaved pintles or knuckles thereof.

Referring to FIG. 16, a further embodiment of the invention 10, means 300 is provided to enhance the frictional engagement of a grapple 40 with the upper surface of a sloped roof 14. The friction enhancement means 300 includes a flat, rectangular, base plate 302 that is shaped and dimensioned to overlie, cover, and adhere to an upper surface of a rectangular friction pad 37 by, for example, hook-and-loop fasteners. Attached to an upper surface of the plate 302 is a third clamp ring 304 and a fourth clamp ring 306 disposed centrally and near one end of said plate respectively. In use, the upper bar 44 of a grapple 40 is inserted through the cylindrical interiors of the clamp rings 304, 306 and secured thereto by rotationally advancing the clamp ring spindles 324, 324 by manually rotating the handles 326.

Thus, it should be evident that a portable safety harness attachment apparatus according to the concepts of the present invention has been shown and described in sufficient detail to enable one of ordinary skill in the art to practice the invention. Since various modifications in detail, materials, arrangements of parts, and equivalents thereof, are within the spirit of the invention herein disclosed and described, the scope of the invention should be limited solely by the scope of the appended patent claims.

I claim:

1. A safety harness attachment apparatus for tethering a workman to the ridge of a pitched roof of a building, said pitched roof including a pair of roof overhangs on opposite sides of said ridge, comprising:

an anchor assembly, said assembly including a hinge comprising first and second hinge plates and a hinge pin inserted through aligned, interleaved knuckles of said hinge plates;

first and second support blocks underlying and attached to the first and second hinge plates, respectively; and means for attaching a proximal end of a tether line to the anchor assembly;

first and second ratchet tie downs, wherein each ratchet tie down includes a ratchet tie down strap threaded therethrough;

each strap extends from a proximal end thereof through the ratchet tie down and thence to an opposite, distal end thereof; and each ratchet tie down includes a handle the reciprocal movement of which ratchets said strap through said ratchet tie down;

first and second grapples, each grapple being shaped and dimensioned for receiving in surrounding engagement a roof overhang, each grapple including an upper bar;

a lower bar that is parallel to said upper bar;

a bight that lies in a plane perpendicular to the upper and lower bars and joins mid portions of said bars to each other, said bight including oppositely-disposed, upper and lower leg portions, said upper leg portion extending from the upper bar in a direction away from the lower bar and said lower leg portion extending from the lower bar in a direction away from the upper bar;

means for attaching a distal end of a ratchet tie down strap of each of the first and second ratchet tie downs to the bight of the first and second grapples adjacent to and above the upper leg portions thereof; and means for attaching a proximal end of a ratchet tie down strap of each of the first and second ratchet tie downs to the first and second hinge plates, respectively.

2. The apparatus of claim 1, wherein the means for attaching a proximal end of a tether line to the anchor assembly includes an upstanding eyebolt attached to the anchor assembly.

3. The apparatus of claim 1, wherein the means for attaching a distal end of a ratchet tie down strap to each of said first and second grapples includes an upstanding, apertured lug attached to the bight of each grapple above the upper bar.

4. The apparatus of claim 1, wherein the means for attaching a distal end of a ratchet tie down strap to each of the first and second ratchet tie downs to the bight of the first and second grapples includes, for each grapple, a shackle assembly, said shackle assembly including an upstanding, mounting plate attached to an upper surface of the bight above the bar;

a U-shaped member; and a parallel pair of arms disposed on opposite sides of the mounting plate, said arms having proximal ends pivotally attached to the mounting plate and opposite, distal ends pivotally attached to the U-shaped member.

5. The apparatus of claim 4, said mounting plate having a partial circular, upper margin disposed at a radial distance R from where the arms are pivotally attached to the mounting plate, and each arm has length greater than R.

6. The apparatus of claim 5, wherein the mounting plate has a plurality of circumferentially spaced-apart apertures adjacent to the upper margin of the mounting plate.

7. The apparatus of claim 3, wherein each of the hinge plates has an apertured, distal end;

each ratchet tie down strap is looped at the proximal and distal ends thereof, thereby forming proximal and distal looped ends, respectively;

the means for attaching a proximal end of a ratchet tie down strap of each of the first and second ratchet tie downs to the first and second hinge plates, respectively, includes for each ratchet tie down, a first toe hook having a first end and an opposite, second end;

the first end of each first toe hook is attached to a proximal, looped end of a ratchet tie down strap, and the second, opposite end of each first toe hook is attachable to an aperture, distal end of a hinge plate by insertion into an aperture thereof;

the means for attaching a distal end of a ratchet tie down strap of each of the first and second ratchet tie downs to the bight of the first and second grapples, respectively, includes, for each ratchet tie down, a second toe hook having a first end and an opposite, second end;

the first end of each of the second toe hooks is attached to a distal, looped end of a ratchet tie down strap; and the second, opposite ends of the second toe hooks are attachable to the bights of the first and second grapples by insertion into apertures of the grapples disposed adjacent to and above the upper leg portions of said bights.

8. The apparatus of claim 7, wherein each of the support blocks includes a friction pad to enhance frictional engagement of the anchor assembly with the pitched roof surfaces.

9. The apparatus of claim 8, further including a tether line having a proximal end that is attachable to an eyebolt of the anchor assembly and an opposite, distal end that is attachable to a safety harness worn by a workman while on said pitched roof.

10. The apparatus of claim 9, wherein the proximal end of the tether line includes a spring-loaded clasp that is attachable to the eyebolt of the anchor assembly and the distal end of the tether line includes a snap hook that is attachable to the safety harness.

11. The apparatus of claim 1, further including a combination clamp ring and locking C-clamp, said combination comprising:

a locking C-clamp, said clamp including a fixed jaw;

a movable jaw pivotally attached to the fixed jaw at a first pivot point;

a stationary handle rigidly attached to the fixed jaw;

a locking handle attached to the movable jaw; and locking means attached to the stationary and locking handles for locking the jaws in position when the jaws straddle and engage opposite sides of an object such as a roof rafter; and a first clamp ring, said clamp ring including a hollow, cylindrical, ring portion tangentially attached to said locking C-clamp at a location on said clamp intermediate the jaws and the handles, said ring portion having a radially-directed aperture with internal thread and having an internal diameter large enough to permit said ring portion to be mounted upon a lower bar of said grapple, and said ring portion having a cylindrical axis that is oriented perpendicular to the stationary handle;

a spindle having an external thread, said spindle being rotationally advanceable into, and withdrawable out of, said radially-directed aperture; and a handle attached to said spindle.

12. A safety harness attachment apparatus for tethering a workman to the ridge of a pitched roof of a building, said pitched roof including a pair of roof overhangs on opposite sides of said ridge, comprising:

an anchor assembly, said assembly including a hinge comprising first and second hinge plates and a hinge pin inserted through aligned, interleaved knuckles of said hinge plates;

first and second support blocks underlying and attached to the first and second hinge plates, respectively; and means for attaching a proximal end of a tether line to the anchor assembly;

first and second ratchet tie downs, wherein each ratchet tie down includes a ratchet tie down strap threaded therethrough;

each strap extends from a proximal end thereof through the ratchet tie down and thence to an opposite, distal end thereof; and each ratchet tie down includes a handle the reciprocal movement of which ratchets said strap through said ratchet tie down;

first and second grapples, each grapple being shaped and dimensioned for receiving in surrounding engagement a roof overhang, each grapple including an upper bar;

a lower bar that is parallel to said upper bar;

a bight that lies in a plane perpendicular to the upper and lower bars and joins mid portions of said bars to each other, said bight including oppositely-disposed, upper and lower leg portions, said upper leg portion extending from the upper bar in a direction away from the lower bar and said lower leg portion extending from the lower bar in a direction away from the upper bar; and means for attaching a distal end of a ratchet tie down strap of each of the first and second ratchet tie downs to the bight of the first and second to the grapple adjacent to and above the upper leg portions thereof; and means for attaching a proximal end of a ratchet tie down strap of each of the first and second ratchet tie downs to the first and second hinge plates, respectively; and friction enhancement means, said means including a flat base plate, said plate having an upper surface and an opposite lower surface;

a central clamp ring attached to a central portion of said upper surface; and an end clamp ring attached to an end portion of said upper surface and aligned with the central clamp ring on a common axis;

wherein each of said central clamp ring and said end clamp ring includes a hollow, cylindrical, ring portion tangentially attached to said upper surface;

said ring portion has a radially-directed aperture with internal thread and an internal diameter large enough to permit said ring portion to be mounted upon an upper bar of said grapple;

a spindle having an external thread, said spindle being rotationally advanceable into, and withdrawable out of, said radially-directed aperture; and a handle attached to said spindle.

13. A method for using a safety harness attachment apparatus to tether a workman wearing a safety harness to the ridge of a pitched roof of a building, said pitched roof including a pair of roof overhangs on opposite sides of said ridge, said apparatus comprising an anchor assembly, said assembly including a hinge comprising first and second hinge plates and a hinge pin inserted through aligned, interleaved knuckles of said hinge plates;

first and second support blocks underlying and attached to the first and second hinge plates, respectively; and means for attaching a proximal end of a tether line to the anchor assembly;

first and second ratchet tie downs, wherein each ratchet tie down includes a ratchet tie down strap threaded therethrough;

each strap extends from a proximal end thereof through the ratchet tie down and thence to an opposite, distal end thereof; and each ratchet tie down includes a handle the reciprocal movement of which ratchets said strap through said ratchet tie down;

first and second grapples, each grapple being shaped and dimensioned for receiving in surrounding engagement a roof overhang, each grapple including an upper bar;

a lower bar that is parallel to said upper bar;

a bight that lies in a plane perpendicular to the upper and lower bars and joins mid portions of said bars to each other, said bight including oppositely-disposed, upper and lower leg portions, said upper leg portion extending from the upper bar in a direction away from the lower bar and said lower leg portion extending from the lower bar in a direction away from the upper bar; and means for attaching a distal end of a ratchet tie down strap of each of the first and second ratchet tie downs to the first and second hinge plates, respectively;

wherein the method comprises the steps of:

placing the anchor assembly on the ridge of the roof such that the hinge pin overlies and is parallel to the ridge and the support blocks rest on the opposite, sloping sides of the pitched roof;

attaching the proximal ends of the straps of the first and second ratchet tie downs to the distal ends of the first and second hinge plates, respectively;

placing the first grapple on the first roof overhang such that the upper bar thereof rests on a peripheral edge portion of the roof and the lower bar thereof engages the roof eave below said peripheral edge portion;

attaching the distal end of the strap of the first ratchet tie down to the first grapple and tightening said strap by reciprocal movement of the first ratchet tie down handle;

placing the second grapple on the second roof overhang such that the upper bar thereof rests on a peripheral edge portion of the roof and the lower bar thereof engages the roof eave below said peripheral edge portion;

attaching the distal end of the strap of the second ratchet tie down to the second grapple and tightening said strap by reciprocal movement of the second ratchet tie down handle;

attaching a proximal end of a tether line to the anchor assembly; and attaching a distal end of the tether line to the safety harness.

14. The method of claim 13, wherein the means for attaching a proximal end of a tether line to the anchor assembly includes an upstanding eyebolt attached to the anchor assembly.

15. The method of claim 14, wherein the means for attaching a distal end of a ratchet tie down strap of each of the first and second ratchet tie downs to each of the first and second grapples, respectively, includes an upstanding, apertured lug attached to each grapple.

16. The method of claim 15, wherein each of the hinge plates has an apertured, distal end;

each ratchet tie down strap is looped at the proximal and distal ends thereof, thereby forming proximal and distal looped ends, respectively;

a first end of each toe hook is attached to each of said proximal and distal looped ends of each strap; and a second, opposite end of each toe hook is attachable to an apertured, distal end of a hinge plate by insertion into the aperture thereof.

17. The method of claim 16, wherein the tether line has a proximal end that is attachable to the eyebolt of the anchor assembly and an opposite, distal end that is attachable to said safety harness.

18. The method of claim 17, wherein the proximal end of the tether line includes a spring-loaded clasp that is attachable to the eyebolt of the anchor assembly and the distal end of the tether line includes a snap hook that is attachable to said safety harness.

19. The method of claim 18, wherein each of the support blocks includes a friction pad to enhance frictional engagement of the anchor assembly with the pitched roof surfaces.

20. The method of claim 14, wherein the means for attaching a distal end of a ratchet tie down strap to each of said first and second grapples includes, for each grapple, a shackle assembly, said shackle assembly including an upstanding, mounting plate attached to an upper surface of the bight, said plate having a plurality of arcuately spaced apart apertures;

a U-shaped member;

a parallel pair of arms disposed on opposite sides of the mounting plate, said arms having proximal ends pivotally attached to the mounting plate and opposite, distal ends pivotally attached to the U-shaped member; and the method includes, prior to tightening the straps of the first and second ratchet tie downs, attaching the distal end of the strap of the first ratchet tie down to the U-shaped member of a first shackle assembly;

pivoting the parallel pair of arms of the first shackle assembly to a user-selectable position and fixing said arms in said position by insertion of an object into an aperture at that position; and pivoting the parallel pair of arms of the second shackle assembly to a user-selectable position and fixing said arms in said position by insertion of an object into an aperture at that position.

* * * * *